US010163386B2

(12) United States Patent
Lee et al.

(10) Patent No.: US 10,163,386 B2
(45) Date of Patent: Dec. 25, 2018

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Dong Gyu Lee, Yongin-si (KR); Seon Ki Kim, Yongin-si (KR); Kyung Youl Min, Yongin-si (KR); Hee Sun Ahn, Yongin-si (KR)

(73) Assignee: Samsung Display Co., Ltd. (KR)

( * ) Notice: Subject to any disclaimer, the term of this patent is extended or adjusted under 35 U.S.C. 154(b) by 120 days.

(21) Appl. No.: 15/159,432

(22) Filed: May 19, 2016

(65) Prior Publication Data

US 2017/0069257 A1 Mar. 9, 2017

(30) Foreign Application Priority Data

Sep. 7, 2015 (KR) ..... 10-2015-0126464

(51) Int. Cl.
*G09G 5/00* (2006.01)
*G09G 3/20* (2006.01)

(52) U.S. Cl.
CPC ..... *G09G 3/2096* (2013.01); *G09G 2310/08* (2013.01)

(58) Field of Classification Search
CPC ..... G09G 3/3648; G09G 2320/0693; G09G 2320/0233; G09G 2320/0646; G09G 3/3233; G09G 2320/045; G09G 3/3283; G09G 3/3291; G09G 3/3685
See application file for complete search history.

(56) References Cited

U.S. PATENT DOCUMENTS 8,314,763 B2 11/2012 Park et al.
2011/0007067 A1* 1/2011 Ryu ..... G09G 3/3233 345/214
2012/0242628 A1* 9/2012 Yuan ..... G09G 3/20 345/204
2012/0281027 A1* 11/2012 Kim ..... G09G 3/3406 345/690
2014/0078133 A1* 3/2014 Lee ..... G09G 3/2092 345/213

FOREIGN PATENT DOCUMENTS

KR 10-1367279 B1 2/2014

* cited by examiner

*Primary Examiner* — Hau H Nguyen
(74) *Attorney, Agent, or Firm* — Innovation Counsel LLP

(57) ABSTRACT

Disclosed is a display device that can rapidly recover from a fail situation. The display device includes: a display panel; a source drive IC configured to supply a data signal to the display panel and including a calibrating unit; a timing controller configured to supply a data control signal and a frame data to the source drive IC; and a common bus line formed between the source drive IC and the timing controller. The calibrating unit sets and stores a calibration value in response to the data control signal during an initialization period before receiving the frame data from the timing controller, and transmits the calibration value to the timing controller through the common bus line.

16 Claims, 6 Drawing Sheets

DISPLAY DEVICE AND DRIVING METHOD THEREOF

CROSS-REFERENCE TO RELATED APPLICATION

This application claims priority to and the benefit of Korean Patent Application No. 10-2015-0126464, filed on Sep. 7, 2015, in the Korean Intellectual Property Office, the disclosure of which is incorporated herein by reference in its entirety.

BACKGROUND

1. Field

The present disclosure relates to a display device and a driving method thereof

2. Description of the Related Art

A display device, such as a liquid crystal display device and an organic light emitting display device, transmits various data required for generating a data signal through an intra-panel interface established between a Timing Controller (TCON) and a source drive integrated circuit (S-IC).

The TCON supplies a data control signal and a frame data to the S-IC. In response, the S-IC generates a data signal in response to the data control signal and the frame data, and outputs the generated data signal to data lines of a display panel.

SUMMARY

The present disclosure provides a display device that can rapidly recover from a fail situation, and a driving method thereof According to one embodiment, the display device includes a display panel, a source drive IC configured to supply a data signal to the display panel and including a calibrating unit, a timing controller configured to supply a data control signal and a frame data to the source drive IC, and a common bus line formed between the source drive IC and the timing controller. The calibrating unit sets and stores a calibration value in response to the data control signal during an initialization period before receiving the frame data from the timing controller, and transmits the calibration value to the timing controller through the common bus line.

The timing controller may store the calibration value transmitted through the common bus line in a first register included in the timing controller together with a checksum, and store the calibration value in an external memory together with the checksum.

The timing controller may alternately store the calibration value in a first region and a second region of the external memory.

The calibrating unit and the timing controller bidirectionally transmit a signal through the common bus line.

The timing controller may transmit a command for requesting an input of the calibration value to the calibrating unit through the common bus line.

The calibrating unit may set the calibration value before receiving the frame data for every frame, and transmit the calibration value to the timing controller when the calibration value is set.

The calibration unit may periodically transmit the calibration value to the timing controller at a predetermined period including at least two frames.

The source drive IC may transmit a fast recovery request to the timing controller through the common source line when an internal register value is deleted.

When the fast recovery request is received, the timing controller may check a checksum of the calibration value previously received from the source drive IC, and transmit the calibration value to the source drive IC when the checksum matches.

When the checksum of the calibration value mismatches, the timing controller may transmit a full-initialization command to the source drive IC.

The display device may include a plurality of source drive ICs, and the common bus line may commonly connect the plurality of source drive ICs and the timing controller.

The timing controller may transmit different IDs to the plurality of source drive ICs.

Another embodiment of the present disclosure provides a method of driving a display device, including: transmitting a data control signal to a source drive IC from a timing controller during an initialization period; setting a calibration value for calibrating the source drive IC in response to the data control signal; storing the calibration value in the source drive IC, and transmitting the calibration value to the timing controller; and storing the calibration value transmitted to the timing controller in an external memory of the timing controller together with a checksum.

The method may further include: storing the calibration value transmitted to the timing controller in a first register in the timing controller together with the checksum.

The initialization period may be disposed before frame data is transmitted from the timing controller to the source drive IC, and the initialization period may be disposed for every frame or at a predetermined period and the calibration value is refreshed, and the refreshed calibration value may be transmitted to the timing controller.

The method may further include: setting a first calibration value through a full-initialization during a first initialization period disposed before transmitting first frame data to the source drive IC from the timing controller; and setting a second calibration value through a partial-initialization that refreshes the first calibration value, during a second initialization period disposed after setting of the first calibration value.

When a plurality of source drive ICs is provided, the timing controller may transmit different IDs to the plurality of source drive ICs, respectively, and each of the plurality of source drive ICs may set the ID as an address for common bus communication, and transmit the calibration value to the timing controller through a common bus line formed between the plurality of source drive ICs and the timing controller.

When the calibration value stored in the source drive IC is deleted during a driving of the display device, the source drive IC may transmit a fast recovery request to the timing controller.

When the fast recovery request is received, the timing controller may check the checksum, and when the checksum matches, the timing controller may transmit the calibration value to the source drive IC.

When the fast recovery request is received, the timing controller may check the checksum, and when the checksum mismatches, the timing controller may transmit a full-initialization command to the source drive IC.

BRIEF DESCRIPTION OF THE DRAWINGS

Example embodiments will now be described more fully hereinafter with reference to the accompanying drawings;

however, they may be embodied in different forms and should not be construed as limited to the embodiments set forth herein. Rather, these embodiments are provided so that the present disclosure will be thorough and complete, and will fully convey the scope of the example embodiments to those skilled in the art.

Figure 1:
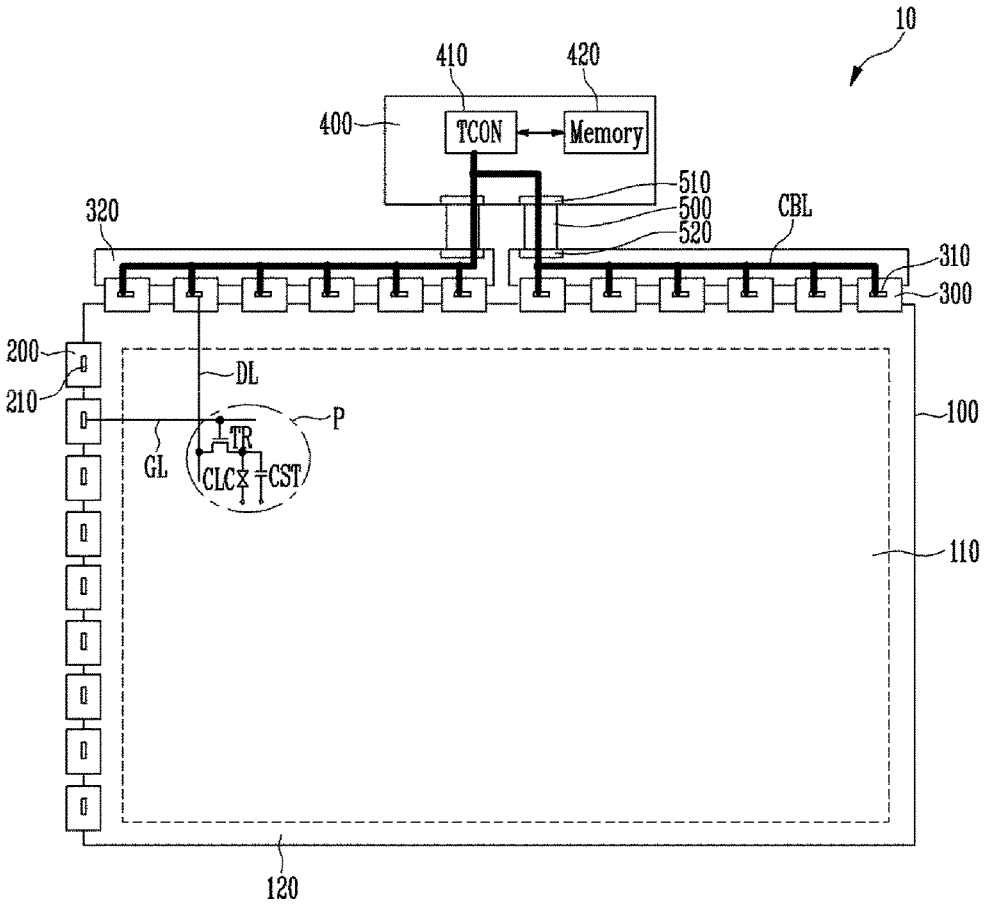

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 1 illustrates a display device, according to one embodiment.

Figure 2:
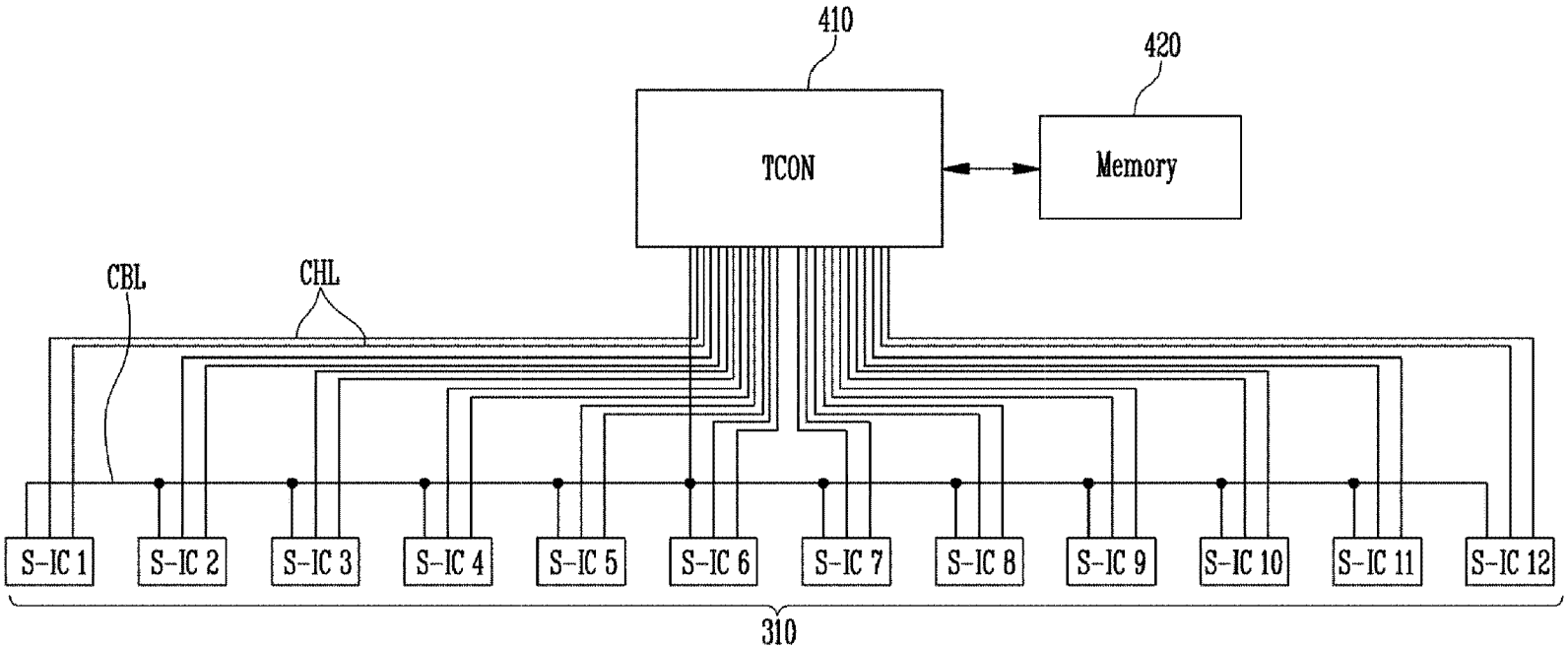

FIG. 2 illustrates signal transmission lines between a timing controller and source drive ICs, according to one embodiment.

Figure 3:
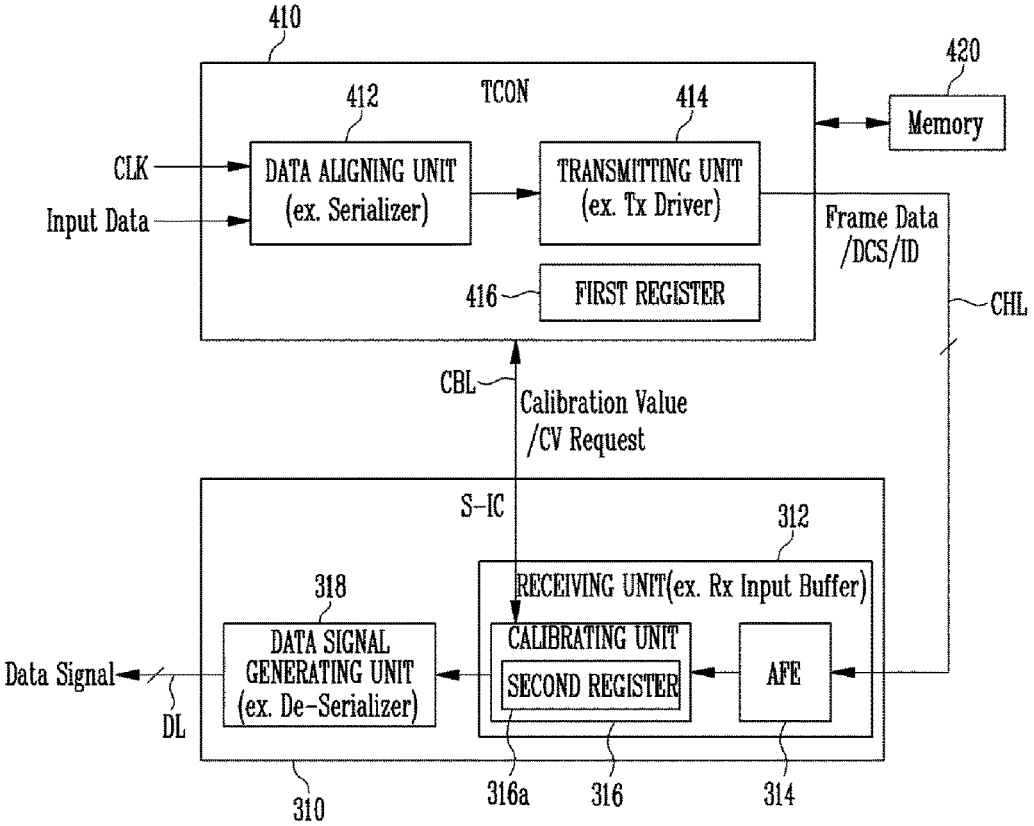

FIG. 3 is a diagram illustrating configurations of a timing controller and each source drive IC, according to one embodiment.

Figure 4:
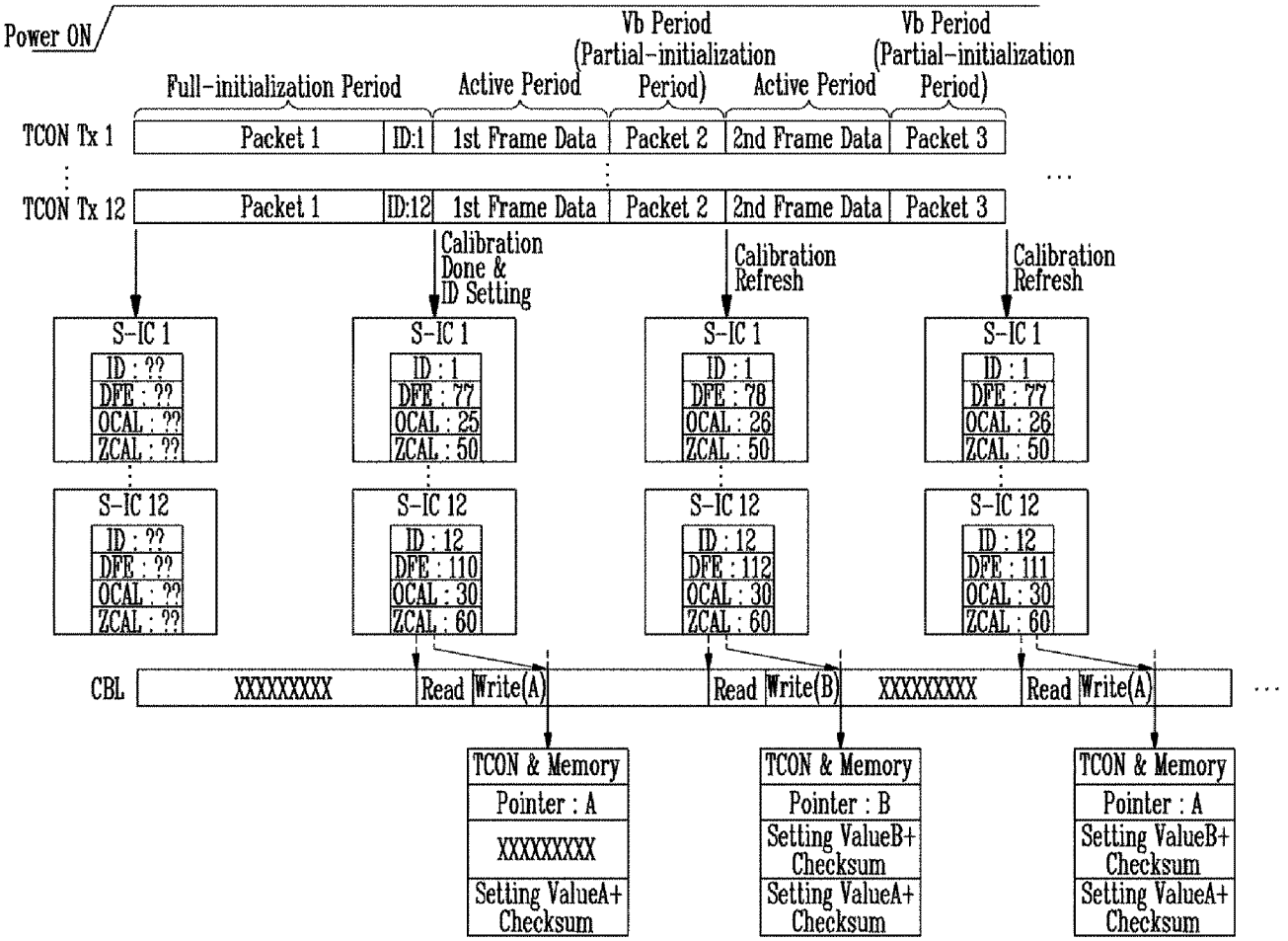

FIG. 4 is a diagram illustrating an operation of a display device in a normal driving mode, according to one embodiment.

Figure 5:
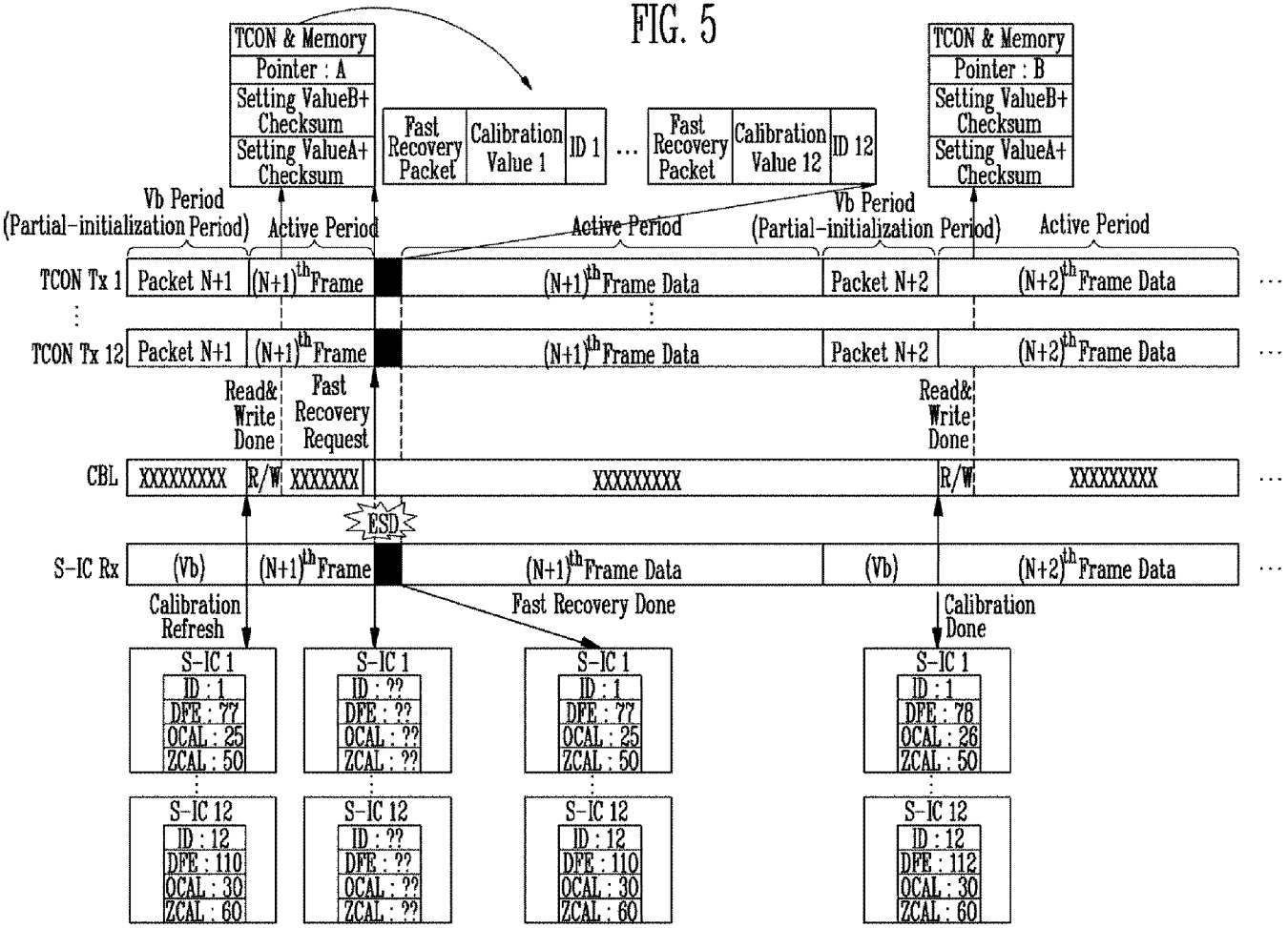

FIG. 5 is a diagram illustrating an operation of a display device in a fast recovery mode, according to the embodiment.

Figure 6:
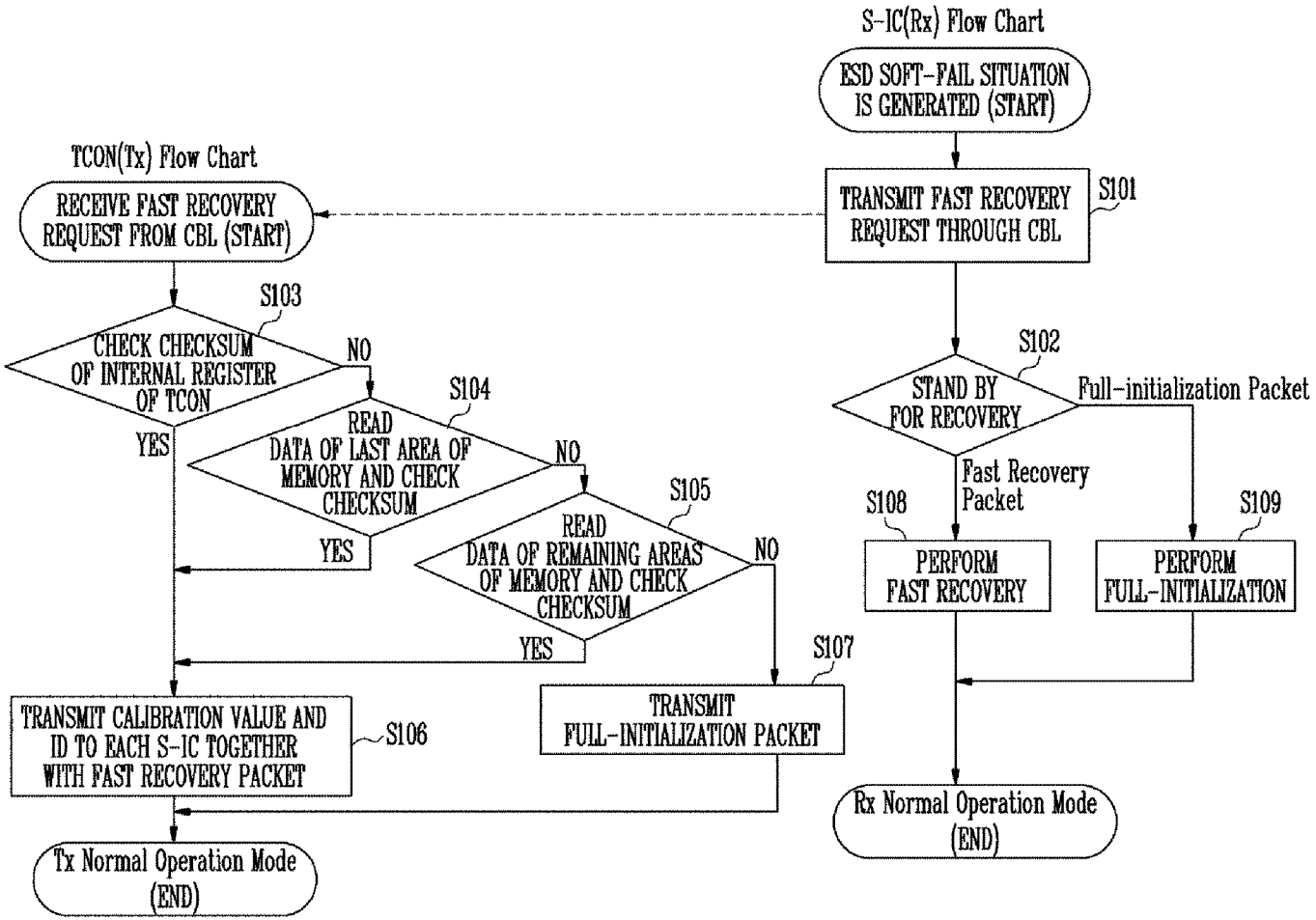

FIG. 6 is a flowchart illustrating a driving method of a timing controller and a source drive IC of a display device in a fast recovery mode, according to one embodiment.

DETAILED DESCRIPTION

Hereinafter, an embodiment of the present disclosure will be described in detail with reference to the accompanying drawings.

FIG. 1 illustrates a display device, according to one embodiment. FIG. 1 illustrates only one gate line and one data line, and one pixel connected to the gate line and the data line, however it is apparent that a display panel includes a plurality of gate lines, a plurality of data lines, and a plurality of pixels connected to the gate lines and the data lines.

FIG. 1 illustrates a liquid crystal display device including a plurality of gate drives ICs and a plurality of source drive ICs as one of the embodiments to which the present disclosure is applicable. However, the present disclosure is not essentially limited to the display device including the plurality of gate drives ICs and the plurality of source drive ICs. For example, the present disclosure is also applicable to a display device including one gate drive IC and one source drive IC. Particularly, the present disclosure may be commonly applied to a display device including one or more source drive ICs, and autonomously setting a calibration value for calibrating the one or more source drive ICs.

Further, the present disclosure is not limited only to the liquid crystal display device. For example, the present disclosure is also applicable to a display device having another form, such as an organic light emitting display device.

Referring to FIG. 1, a display device 10 includes a display panel 100, a plurality of gate drive ICs 210 and a plurality of source drive ICs 310 for driving the display panel 100, and a timing controller 410 for controlling the gate drive ICs 210 and the source drive ICs 310.

The display panel 100 includes a plurality of gate lines GL and a plurality of data lines DL, a display area 110 including a plurality of pixels connected to the plurality of gate lines GL and the plurality of data lines DL, and a non-display area 120 outside the display area 110.

Each of the pixels P includes a switching element TR, a liquid crystal capacitor CLC, and a storage capacitor CST. The switching element TR is connected to a gate line GL and a data line DL, on which a corresponding pixel P is disposed. The liquid crystal capacitor CLC is connected to the switching element TR, and the storage capacitor CST is connected to the liquid crystal capacitor CLC. When a gate signal is supplied from the gate line GL, each of the pixels receives a data signal from the data line DL. The pixels P stores the received data signal, and controls an emission quantity of light supplied from a backlight (not illustrated) in accordance with the stored data signal, thereby display luminance corresponding to the data signal.

Each of the gate drive ICs 210 receives a gate control signal from the timing controller 410, and generates gate signals in response to the received gate control signal. The gate signals generated by the gate drive ICs 210 are supplied to the gate lines GL of an allocated area. As an embodiment, the gate drive ICs 210 may be mounted in gate drive circuit films 200, respectively, and connected to the timing controller 410 that is mounted in a control board 400 via at least one of a source drive circuit film 300, a source printed circuit board 320, and a cable (or a flexible circuit board) 500. However, the present disclosure is not essentially limited thereto, and as another embodiment, the gate drive ICs 210 may also be formed on the display panel 100 together with the pixels P.

The source drive ICs 310 receive a data control signal and a frame data from the timing controller 410, and generate data signals in response to the received data control signal and frame data. The data signals generated by the source drive ICs 310 are supplied to the data lines DL of an allocated area. As an embodiment, the source drive ICs 310 may be mounted in the source drive circuit films 300, respectively, and connected to the timing controller 410 that is mounted in the control board 400 via at least one of the source drive circuit films 300 and the cable 500.

The timing controller 410 receives a control signal including a clock signal from the outside, and generates a gate control signal and a data control signal in response to the received control signal. The gate control signal is supplied to the gate drive ICs 210, and the data control signal is supplied to the source drive ICs 310. Further, the timing controller 410 re-aligns input data from the outside, and supplies the re-aligned input data to the source drive ICs 310 as a frame data. As an embodiment, the timing controller 410 may be mounted in the control board 400 and connected to each gate drive circuit film 200 and/or each source drive circuit film 300 via at least one of the source printed circuit board 320 and the cable 500.

In addition to the timing controller 410, a separate memory 420 may be included in the control board 400. As an embodiment, the memory 420 may be a non-volatile random-access memory (NVRAM).

The cable 500 electrically connects the control board 400 and one or more source printed circuit board 320 through upper and lower connectors 510 and 520. The cable 500 collectively refers to a device including a wire that may electrically connect the control board 400 and the source printed circuit board 320. For example, the cable 500 may be implemented as a flexible circuit board.

As an embodiment, when the plurality of source printed circuit boards 320 are provided, the plurality of cables 500 may be provided.

The display device 10 includes a common bus line CBL formed between the source drive ICs 310 and the timing controller 410. The common bus line CBL may be separately designed from channel lines that are formed between the timing controller 410 and each source drive IC 310 and transmit the data control signal and the frame data to the source drive ICs 310 from the timing controller 410. When only one source drive IC 310 is provided, the common bus line CBL may be separated from the channel line for transmitting the data control signal and the frame data between the source drive IC 310 and the timing controller 410.

The common bus line CBL may transmit a signal bidirectionally between the source drive ICs 310 and the timing controller 410. To this end, a bidirectional serial communication port, for example, an $I^2C$, may be embedded in the source drive ICs 310 and the timing controller 410.

In the present disclosure, each source drive IC 310 sets a calibration value and transmits the calibration value to the timing controller 410 via the common bus line CBL. The timing controller 410 stores the calibration value of each of the source drive ICs 310 in an internal register and the external memory 420 to safely back up the calibration values.

when a soft fail situation occurs and an internal register value (e.g., a calibration value stored in a source drive IC 310) is deleted (for example, caused by electro static discharge), to the display device 100 can rapidly restore the calibration value of the source drive IC 310 by receiving the backup calibration value from the timing controller 410. Accordingly, the display device 100 can rapidly recover from a soft fail situation and return to a normal operation mode without going through a full-initialization process.

The display device and a driving method thereof will be described in more detail below with reference to FIGS. 2 to 6.

FIG. 2 illustrates signal transmission lines between a timing controller and source drive ICs, according to one embodiment. FIG. 3 is a diagram illustrating configurations of a timing controller and each source drive IC, according to the embodiment.

FIG. 2 illustrates 12 source drive ICs, S-IC 1 to S-IC 12, and FIG. 3 schematically illustrates internal configurations of the timing controller and one of the source drive ICs connected to the timing controller. According to one embodiment, each of the source drive ICs may be identically configured. Each of the source drive ICs is connected to a set of corresponding data lines of an allocated area among the data lines that are formed on the display panel to supply the data signal.

Referring to FIGS. 2 and 3, the common bus line CBL and a plurality of channel lines CHL are formed between the source drive ICs 310 and the timing controller 410.

The channel lines CHL are formed between each of the source drive ICs 310 and the timing controller 410. FIG. 2 illustrates that two channel lines CHL are formed between each source drive IC 310 and the timing controller 410. However, the number of channel lines CHL connected to each source drive IC 310 may be variously changed without deviating from the scope of the present disclosure.

The channel lines CHL may be used for transmitting a data control signal DCS and a frame data from the timing controller 410 for driving a corresponding source drive IC 310.

According to one embodiment, each of the source drive ICs 310 is assigned with a unique ID associated with a calibration value for each source drive IC 310. The unique IDs of the source drive ICs 310 may be transmitted from the timing controller 410 to the corresponding source drive ICs 310 through the channel lines CHL. For example, after the display device 10 is powered on, during a full-initialization period before transmitting a first frame data, the timing controller 410 may transmit a data control signal DCS to the channel lines CHL that are connected with each source drive IC 310 and transmit the unique ID to each source drive IC 310.

In the present example, the common bus line CBL commonly connects the source drive ICs S-IC 1 to S-IC 12 to the timing controller 410. In one embodiment, the common bus lines CBL may be directly connected between a calibrating unit 316 of each source drive IC 310 and the timing controller 410 without passing through an analog front end (AFE) 314.

The common bus lines CBL may be used for transmitting a calibration value (CV) request command from the timing controller 410 to the source drive ICs 310 and/or transmitting the calibration value stored in the source drive ICs 310 to the timing controller 410. To this end, the common bus lines CBL may transmit a signal bidirectionally.

The timing controller 410 includes a data aligning unit 412, a transmitting unit 414, and a first register 416.

The data aligning unit 412 receives input data and a control signal including a clock signal CLK from the outside (for example, a graphic card). The data aligning unit 412 re-aligns the input data in response to the control signal, such as the clock signal CLK, and transmits the re-aligned input data to the transmitting unit 414. In one embodiment, the data aligning unit 412 may include a serializer.

Further, the data aligning unit 412 generates the data control signal DCS in response to the input control signal, and transmits the generated data control signal DCS to the transmitting unit 414. The data control signal DCS may be transmitted in a form of a packet including information, for example, a clock training pattern, required for an initialization operation of each source drive IC 310.

The transmitting unit 414 transmits the data control signal DCS to the source drive ICs 310, and transmits the re-aligned input data to the source drive ICs 310 as a frame data. In one embodiment, the transmitting unit 414 may include a transmitting terminal (Tx) driver.

The transmitting unit 414 includes a channel corresponding to each source drive IC 310, and transmits the data control signal DCS and the frame data to the corresponding source drive IC 310 through the channel lines CHL formed in each channel.

Further, the transmitting unit 414 may transmit a unique ID assigned to each source drive IC 310 to each source drive IC 310 through the channel lines CHL formed in each channel.

In a soft fail situation caused by ESD and the like, the transmitting unit 414 may determine the previously backed-up calibration values based on the channel and transmit the backup calibration values. As an embodiment, the backup calibration values may be transmitted to the channel lines CHL that are formed between the respective source drive ICs 310 and the transmitting unit 414 of the timing controller 410.

Information generated by the timing controller 410 or transmitted to the timing controller 410 may be stored in the first register 416. In the present embodiment, the calibration value received from each of the source drive ICs 310 may be stored in the first register 416.

The timing controller 410 transmits the data control signal DCS containing information required for an initialization process and an individual ID to the source drive ICs 310, and transmits the CV request command requesting the transmission of the calibration value to the source drive ICs 310.

The timing controller 410 may transmit the CV request command to the calibrating units 316 of the source drive ICs 310 through the common bus lines CBL connected between the calibrating units 316 of the source drive ICs 310 and the timing controller 410, and receive the calibration values from the calibrating units 316 of the source drive ICs 310 through the common source line CBL.

The timing controller 410 may sequentially read the calibration values for each of the source drive ICs 310 transmitted through the common bus lines CBL according to their unique IDs, and stores the calibration values in the first register 416 of the timing controller 410 together with a checksum. During the process, the unique ID assigned for each source drive IC 310 may be used, so that it is possible to determine the calibration values for each source drive IC 310 based on the associated unique IDs, and transmit and store the calibration values without dualizing each source drive IC 310 or adding a physical pin.

Further, the timing controller 410 stores the calibration values of the source drive ICs 310 in the external memory 420 together with the checksum, in addition to the internal first register 416. When the calibration values of the source drive ICs 310 are stored in the external memory 420, the calibration values may be safely backed up from the external memory 420 when the register value of the timing controller 410 and the register values of the source drive ICs 310 are deleted by ESC.

In one embodiment, the timing controller 410 may alternately store the calibration values of the source drive ICs 310 and the checksum in a first area and a second area of the external memory 420. In this case, when a calibration value of a corresponding frame is not completely stored due to an inflow of ESD while the calibration values of the source drive ICs 310 are received through the common bus line CBL, the display device 10 can rapidly recover to a normal driving mode by using a calibration value of a previous frame.

The timing controller 410 may request the calibrating unit 316 of each source drive IC 310 to transmit the calibration value for every initialization period before the transmission of the frame data, or at a predetermined period set including two or more frames. That is, the period for receiving the calibration value of each source drive IC 310 by the timing controller 410 may be variously changed.

Each source drive IC 310 includes a receiving unit 312 and a data signal generating unit 318. The receiving unit 312 receives the data control signal DCS and the frame data from the timing controller 410, and transmits the received data control signal DCS and frame data to the data signal generating unit 318. In one embodiment, the receiving unit 312 may include a receiving terminal (Rx) input buffer.

In the present embodiment, the receiving unit 312 includes the calibrating unit 316 for calibrating a calibration value of each source drive IC 310 together with the AFE 314.

In one embodiment, the calibrating unit 316 may set and store a calibration value of the source drive IC 310 in response to the data control signal DCS transmitted from the timing controller 410 during an initialization period before an activation period, in which each frame data is transmitted, and transmit the calibration value to the timing controller 410 through the common bus lines CBL for each predetermined period.

More particularly, the calibrating unit 316 performs an initialization for searching for an optimal calibration value of a corresponding source drive IC 310 by using initialization information contained in the data control signal DCS, and sets the optimal calibration value of a corresponding frame.

The calibrating unit 316 may set a calibration value by a full-initialization during a first part of the initialization period after power-on. The first part of the initialization period, in which the full-initialization is performed, may include several frames. For example, the first part of the initialization period for performing a full-initialization is 100 ms.

Further, during the initialization period (for example, every vertical blank period) after the calibration value is set one or more times, the calibrating unit 316 searches for an optimal calibration value within a short period by a partial-initialization based on the previously set calibration value (for example, the calibration value of the previous frame stored in the second register 316*a*), refreshes the calibration value based on the optimal calibration value, and stores the refreshed calibration value in the second register 316*a*.

During the partial-initialization period, during which a partial-initialization is performed, the initialization may be performed within a short period compared to the full-initialization period. For example, the initialization period during the driving, during which the partial-initialization is performed, may be a partial-initialization period taken a time within one frame. The partial-initialization period may be disposed within a vertical blank period of every frame, or a vertical blank frame of a predetermined frame for each predetermined period.

The calibration value set by the calibrating unit 316 is stored in the internal second register 316*a*, and is transmitted to the timing controller 410 through the common bus line CBL for each predetermined period.

For example, the calibrating unit 316 may set the calibration value before receiving an input of the frame data for every frame, and transmit the calibration value to the timing controller 410 whenever the calibration value is set for every frame.

Otherwise, the calibrating unit 316 may transmit the calibration value to the timing controller 410 at a predetermined period including at least two frames, instead of transmitting the calibration value to the timing controller 410 for every frame. The calibration value transmitted to the timing controller 410 is backed up in the first register 416 of the timing controller 410 and the external memory 420.

In one embodiment, the calibrating unit 316 may be an equalizer. Further, the calibration value set by the calibrating unit 316 may include a decision feedback equalizer DFE value, an offset calibration value OCAL, and/or an impedance calibration value ZCAL of each source drive IC 310.

The receiving unit 312 calibrates the frame data received through the AFE 314 by applying the optimized calibration value for each source drive IC 310, and then supplies the calibrated frame data to the data signal generating unit 318.

The data signal generating unit 318 generates a data signal corresponding to the frame data received from the calibrating unit 316, and outputs the generated data signal to the data lines DL that is connected to the corresponding source drive IC 310. In one embodiment, the data signal generating unit 318 may be configured to include a de-serializer.

The calibrating unit 316 optimizes an output characteristic of the corresponding source drive IC 310. Accordingly, the display device 10 can overcome image quality deterioration that may occur due to a long-distance high-rate data transmission between the timing controller 410 and the source drive ICs 310 and improve an image quality of a large and high-definition display device.

As described above, the common bus line CBL is formed between the timing controller 410 and the source drive ICs 310 (for example, the calibrating units 316 of the respective source drive ICs 310). Further, the calibration value that is optimized by the source drive IC 310 during an initialization period is transmitted to the timing controller 410 through the common bus line CBL for each predetermined period for backup.

According to one embodiment, when the calibration value that is set and stored in the source drive IC 310 is deleted by ESD and the like, it is possible to rapidly restore the calibration values from the timing controller 410.

For example, when the calibration value set within each source drive IC 310 is deleted by ESD during the driving of the display device 10, each source drive IC 310 may transmit a fast recovery request to the timing controller 410 through the common source line CBL. The timing controller 410 in response to the fast recovery request may check the calibration value previously received from the source drive IC 310 by using the checksum, and when the checksum of the calibration value matches, the timing controller 410 may transmit the stored calibration value to each source drive IC 310.

Accordingly, the display device can rapidly return to a normal driving mode without going through a full-initialization process during a fail situation caused by ESD and the like.

FIG. 4 is a diagram illustrating an operation of a display device in a normal driving mode, according to one embodiment.

Referring to FIG. 4, after the display device 10 is powered on), during a first part of the initialization period (i.e., a full-initialization period), the timing controller 410 transmits a data control signal Packet 1 of a first packet containing information required for the full-initialization to each of the source drive ICs S-IC 1 to S-IC 12 through each of the channels TCON Tx 1 to TCON Tx 12. Subsequent to the first control signal Packet 1 of the first packet, the timing controller 410 transmits unique IDs (for example, IDs 1 to 12) assigned to the source drive ICs S-IC 1 to S-IC 12, respectively, to each of the source drive ICs S-IC 1 to S-IC 12 through each of the channels TCON Tx 1 to TCON Tx 12 during a second part of the full-initialization period.

In one embodiment, the timing controller 410 transmits the data control signal DCS and the ID transmitted to each of the source drive ICs S-IC 1 to S-IC 12 through one or more channel lines CHL that are formed between each of the channels TCON Tx 1 to TCON Tx 12 and the source drive ICs S-IC 1 to S-IC 12.

After the full-initialization period is ended, during an active period of every frame, the timing controller 410 transmits frame data of a corresponding frame to each of the source drive ICs S-IC 1 to S-IC 12 through each of the channels TCON Tx 1 to TCON Tx 12 of the transmitting unit 414.

In each vertical blank period (Vb period) disposed between the active periods of the respective frames, the timing controller 410 transmits data control signals Packet 2, Packet 3, . . . of the packets containing information required for the partial-initialization to each of the source drive ICs S-IC 1 to S-IC 12 through each of the channels TCON Tx 1 to TCON Tx 12.

In a state where the full-initialization is not performed immediately after the power-on, various calibration values, for example, a DFE, an OCAL, and/or a ZCAL, may not be set in the second register **316*a* of each of the source drive ICs S-IC 1 to S-IC 12**.

Each of the source drive ICs S-IC 1 to S-IC 12 searches for and sets an optimal calibration value of each of the source drive ICs S-IC 1 to S-IC 12 by performing a full-initialization in response to the data control signal Packet 1 of the first packet received during the full-initialization period.

The calibration value set in each of the source drive ICs S-IC 1 to S-IC 12 is stored in the second register **316*a* in each of the source drive ICs S-IC 1 to S-IC 12** together with an individual ID.

Further, each of the source drive ICs S-IC 1 to S-IC 12 re-sets the calibration value within a short period by refreshing the previously set calibration value and performing a partial-initialization in response to the data control signals Packet 2, Packet 3, . . . in the form of the packet received during each Vb period (partial-initialization period). The refreshed calibration value may be updated and stored in the second resister **316*a* of each of the source drive ICs S-IC 1 to S-IC 12**.

The calibration values stored in each of the source drive ICs S-IC 1 to S-IC 12 are transmitted to the timing controller 410 in each predetermined period.

For example, the timing controller 410 may transmit the data control signals Packet1, Packet 2, Packet 3, . . . through the channel lines CHL for every initialization period of every frame, and transmit a CV request command through the common bus line CBL. Rach of the source drive ICs S-IC 1 to S-IC 12 transmits the calibration value set to the timing controller 410 through the common bus line CBL.

Each of the source drive ICs S-IC 1 to S-IC 12 may set the unique ID received from the timing controller 410 during the full-initialization period as an address for common bus communication.

After the calibration values of the source drive ICs S-IC 1 to S-IC 12 are completely set, the timing controller 410 sequentially reads the calibration values set in the source drive ICs S-IC 1 S-IC 12. The timing controller 410 stores the fetched calibration values in the first register 416 in the timing controller 410 and/or the external memory 420 together with the checksum and backs up the fetched calibration values.

In one embodiment, the timing controller 410 may alternately store the calibration values fetched from the source drive ICs S-IC 1 to S-IC 12 in a first region (region A) of the memory 420 and a second region (region B) of the memory 420. When a calibration value of a source drive IC is newly stored in the memory 420, a pointer region value (for example, region A or B) that indicates a recent storage location is stored together. In this case, the memory 420 may include the two regions (region A and region B) to store the calibration value of the source drive IC and the checksum together, and the pointer region that indicates the recent storage location. The number of regions of the memory 420 that stores the calibration value may be changed.

When a calibration value fetched from a source drive IC is alternately stored in the plurality of regions (region A and region B) of the memory 420, it is possible to fast recover the source drive IC in a normal driving mode by using the calibration value that is pre-stored in another region when the calibration value of the corresponding frame fails to be completely stored due to an inflow of ESD while receiving the calibration value of the source drive IC.

FIG. 5 is a diagram illustrating an operation of a display device in a fast recovery mode, according to the embodiment. FIG. 5 illustrates an ESD-induced soft fail situation while $(N+1)^{th}$ (N is a natural number) frame data is transmitted as an example.

Referring to FIG. 5, ESD flowing in from the outside while $(N+1)^{th}$ frame data is transmitted may interrupt the transmission of the $(N+1)^{th}$ frame data and cause a soft fail situation to delete the calibration values stored in the source drive ICs S-IC 1 to S-IC 12.

In this case, in order to autonomously re-set the deleted calibration values within the source drive ICs S-IC 1 to S-IC 12, a full-initialization requiring several frames may need to be performed.

However, according to the present disclosure, when an ESD-induced soft fail situation occurs, one or more source drive ICs S-IC 1 to S-IC 12 notify an abnormal situation by transmitting a fast recovery request through the common bus line CBL, and stand by for a recovery.

When the fast recovery request is received through the common bus lines CBL, the timing controller 410 checks data and a checksum of the calibration value stored in the internal first register 416 and/or the external memory 420.

When the timing controller 410 finds data having a matched checksum, the timing controller 410 transmits the corresponding calibration value to the source drive ICs S-IC 1 to S-IC 12 together with a fast recovery packet and an individual ID.

In this case, the timing controller 410 may simultaneously transmit the fast recovery packet and the calibration value and/or the individual ID of each of the source drive ICs S-IC 1 to S-IC 12 to the channel lines CHL that are connected with each of the source drive ICs S-IC 1 to S-IC 12. In one embodiment, the timing controller 410 may simultaneously transmit the calibration value of the source drive ICs S-IC 1 to S-IC 12 through the channel lines CHL that are connected with each of the source drive ICs S-IC 1 to S-IC 12 together with the ID.

Each of the source drive ICs S-IC 1 to S-IC 12 completes the fast recovery and returns to a normal operation mode by setting and storing the received calibration value as an internal calibration value.

Further, the timing controller 410 transmitting the calibration value to each of the source drive ICs S-IC 1 to S-IC 12 also returns to a normal operation mode and re-transmits the $(N+1)^{th}$ frame data that was interrupted by ESD.

FIG. 6 is a flowchart illustrating a driving method of a timing controller and a source drive IC of a display device in a fast recovery mode, according to the embodiment. Similar to FIG. 5, FIG. 6 illustrates an example of an ESD-induced soft fail situation caused by ESD flowing in while the $(N+1)^{th}$ frame data is transmitted.

Referring to FIG. 6, when an ESD-induced soft fail situation occurs, the fast recovery mode of each source drive IC 310 starts.

When the ESD-induced soft fail situation occurs, the source drive IC 310 notifies an abnormal situation by transmitting a fast recovery request through the common bus line CBL, and stands by for a recovery (S101 and S102).

The timing controller 410 receives the fast recovery request through the common bus lines CBL and starts a fast recovery mode.

When the fast recovery mode starts, the timing controller 410 checks a previously stored calibration value by using a checksum.

In one embodiment, the timing controller 410 sequentially checks a checksum stored in the internal first register 416, a checksum stored in the last region of the external memory 420, and checksums stored in the remaining regions of the external memory 420 (S103, S104, and S105).

When the timing controller 410 finds data having a matched checksum, the timing controller 410 stops checking the checksum, and transmits a calibration value of each source drive IC 310 that is confirmed by the checksum, and an ID to each source drive IC 310 together with a fast recovery packet (S106).

For example, when the checksum of the first register 416 matches, the timing controller 410 transmits the calibration value and the ID of each source drive IC 310 that are stored in the first register 416 to each source drive IC 310 together with the fast recovery packet that contains information required for a fast recovery.

The ESD may further flow in the timing controller 410, and the calibration value stored in the first register 416 may also be deleted.

When the checksum of the first register 416 mismatches, the timing controller 410 fetches the last data stored in the memory 420 (that is, data of the last region) and checks the checksum.

When the fetched checksum matches, the timing controller 410 transmits the calibration value of each source drive IC 310 stored in the last region of the memory 420 and the ID to each source drive IC 310 together with a fast recovery packet.

In the meantime, when the checksum of the data stored in the last region of the memory 420 mismatches, the timing controller 410 fetches the data stored in the remaining regions of the memory 420 and checks the checksum of the fetched data.

When the fetched checksum matches, the timing controller 410 transmits the calibration value of each source drive IC 310 stored in the remaining regions of the memory 420 and the ID to each source drive IC 310 together with a fast recovery packet.

When all of the checksums of the data stored in the first register 416 of the timing controller 410 and the external memory 420 mismatch, the timing controller 410 transmits a full-initialization packet including a full-initialization command to each source drive IC 310 (S107).

The timing controller 410 terminates the fast recovery mode after transmitting the fast recovery packet or the full-initialization packet to each source drive IC 310, and returns to a normal operation mode.

Using the calibration value and the ID that are transmitted together with the fast recovery packet from the timing controller 410, each source drive IC 310 performs a fast recovery by setting and storing the received calibration value as an internal calibration value (S108).

When the timing controller 410 transmits a full-initialization packet, each source drive IC 310 searches for an optical calibration value by performing a full-initialization, and sets the optimal calibration value as a new calibration value (S109).

The calibration value set in each source drive IC 310 may be transmitted to the timing controller 410 and backed up in the first register 416 of the timing controller 410 and/or the memory 420.

After completing the fast recovery or the full-initialization, the source drive IC 310 terminates the fast recovery mode and returns to a normal operation mode.

According to one embodiment, a source drive IC of a display device receives a data control signal before receiving a frame data, and sets a calibration value for calibrating an output characteristic in response to the received data control signal. The calibration value is stored inside the source drive IC.

When ESD flows into the display device and a soft fail situation occurs the calibration value stored inside the source drive IC may be deleted. In this case, to the display device may need to re-set the calibration value requiring a recovery time of several frames for full initialization. During the recovery time, the display device may not normally display an image.

According to one embodiment, a common bus line is formed between a timing controller and the source drive IC, and a calibration value that is set within the source drive IC is transmitted to the timing controller during an initialization period through the common bus line, and backed up. When the calibration value stored in the source drive IC is deleted, for example, in an ESD-induced soft fail condition, the display device can rapidly restore the calibration value by receiving the calibration value from the timing controller.

Accordingly, in response to a fail situation, to the display device can rapidly recover and return to a normal driving mode without going through a full-initialization process.

Example embodiments have been disclosed herein, and although specific terms are employed, they are used and are to be interpreted in a generic and descriptive sense only and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure.

What is claimed is:

1. A display device, comprising:

a display panel;

a plurality of source drive ICs, each of the plurality of source drive ICs including a calibrator;

a timing controller configured to supply a data control signal and a frame data to each of the plurality of source drive ICs; and a common bus line commonly connecting the plurality of source drive ICs and the timing controller, wherein the calibrator sets and stores a calibration value in a corresponding source drive IC of the plurality of source drive ICs in response to the data control signal during an initialization period before receiving the frame data from the timing controller, and transmits the calibration value to the timing controller through the common bus line, wherein the timing controller stores the calibration value in at least one of an internal first register and an external memory, wherein a source drive IC of the plurality of source drive ICs transmits a fast recovery request to the timing controller through the common bus line when the calibration value stored in the source drive IC is deleted, to restore the calibration value, and the timing controller transmits the calibration value that is previously received from the source drive IC to the source drive IC in response to the fast recovery request, and wherein the calibrator and the timing controller bidirectionally transmit a signal through the common bus line.

2. The display device of claim 1, wherein the timing controller stores the calibration value in the internal first register together with a checksum, and stores the calibration value in the external memory together with the checksum.

3. The display device of claim 2, wherein the timing controller alternately stores the calibration value in a first region and a second region of the external memory.

4. The display device of claim 1, further comprising a plurality of channel lines formed between each of the plurality of source drive ICs and the timing controller, wherein the timing controller supplies the data control signal and the frame data to each of the plurality of source drive ICs through a respective channel line of the plurality of channel lines.

5. The display device of claim 1, wherein the timing controller transmits a command for requesting an input of the calibration value to the calibrator through the common bus line.

6. The display device of claim 1, wherein the calibrator sets the calibration value before receiving the frame data for every frame, and transmits the calibration value to the timing controller through the common bus line when the calibration value is set.

7. The display device of claim 1, wherein the calibrator periodically transmits the calibration value to the timing controller through the common bus line at a predetermined period including at least two frames.

8. The display device of claim 1, wherein when the fast recovery request is received, the timing controller checks a checksum of the previously received calibration value, and transmits the calibration value to the source drive IC through a corresponding channel line when the checksum matches.

9. The display device of claim 8, wherein when the checksum of the calibration value mismatches, the timing controller transmits a full-initialization command to the source drive IC.

10. The display device of claim 1, wherein the timing controller transmits different IDs to the plurality of source drive ICs.

11. A method of driving a display device, comprising:

transmitting a data control signal to a source drive IC of a plurality of source drive ICs from a timing controller during an initialization period through a channel line;

setting a calibration value for calibrating the source drive IC in response to the data control signal;

storing the calibration value in the source drive IC, and transmitting the calibration value to the timing controller through a common bus line, wherein the common bus line commonly connects the plurality of source drive ICs and the timing controller; and storing the calibration value transmitted to the timing controller in at least one of a first register in the timing controller and an external memory of the timing controller together with a checksum, wherein the source drive IC transmits a fast recovery request to the timing controller through the common bus line when the calibration value stored in the source drive IC is deleted during a driving of the display device, to restore the calibration value, and the timing controller transmits the calibration value that is previously received from the source drive IC to the source drive IC in response to the fast recovery request, and wherein the source drive IC and the timing controller bidirectionally transmit a signal through the common bus line.

12. The method of claim 11, wherein the initialization period is disposed before frame data is transmitted from the timing controller to the source drive IC through the channel line, and wherein the initialization period is disposed for every frame or at a predetermined period and the calibration value is refreshed, and the refreshed calibration value is transmitted to the timing controller through the common bus line.

13. The method of claim 11, further comprising:

setting a first calibration value through a full-initialization during a first initialization period disposed before transmitting first frame data to the source drive IC from the timing controller through the channel line; and setting a second calibration value through a partial-initialization that refreshes the first calibration value, during a second initialization period disposed after setting of the first calibration value.

14. The method of claim 11, wherein the timing controller transmits different IDs to the plurality of source drive ICs, respectively, and each of the plurality of source drive ICs sets the ID as an address for common bus communication through the common bus line.

15. The method of claim 11, wherein when the fast recovery request is received, the timing controller checks the checksum, and when the checksum matches, the timing controller transmits the calibration value to the source drive IC.

16. The method of claim 11, wherein when the fast recovery request is received, the timing controller checks the checksum, and when the checksum mismatches, the timing controller transmits a full-initialization command to the source drive IC.

* * * * *